US005224633A

United States Patent [19]

Senart

[11] Patent Number: 5,224,633

[45] Date of Patent: Jul. 6, 1993

[54] PRESSURIZABLE LIQUID SQUIRTING TOY

[76] Inventor: Joseph C. Senart, 19771 Meredith, Euclid, Ohio 44119

[21] Appl. No.: 767,982

[22] Filed: Sep. 30, 1991

[51] Int. Cl.[5] ..... B67D 37/00

[52] U.S. Cl. ..... 222/209; 222/215; 222/527

[58] Field of Search ..... 222/630-634, 222/78, 79, 209, 215, 527, 401

[56] References Cited

U.S. PATENT DOCUMENTS

| | | | |
|---|---|---|---|
| 466,336 | 1/1892 | Franklin | 222/209 X |
| 1,394,456 | 10/1921 | Wanat | 222/79 X |
| 1,546,940 | 7/1925 | Pennington | 222/209 X |
| 2,431,596 | 11/1947 | Wickstrum | 222/209 X |
| 2,596,216 | 5/1952 | Dawson . | |
| 2,795,245 | 6/1957 | Meehan | 222/209 X |
| 3,181,270 | 5/1965 | Trevena . | |
| 3,461,868 | 8/1969 | Palich | 222/215 X |
| 4,239,129 | 12/1980 | Esposito . | |
| 4,630,756 | 12/1986 | Amici et al. . | |
| 4,689,033 | 8/1987 | Droller et al. . | |
| 4,703,892 | 11/1987 | Nadel | 222/215 X |
| 4,991,777 | 2/1991 | Sato | 222/215 X |
| 5,004,128 | 4/1991 | Richichi et al. | 222/527 |

OTHER PUBLICATIONS

The Enthusiast—Summer 1991 catalog page.

*Primary Examiner*—Kevin P. Shaver

*Attorney, Agent, or Firm*—Fay, Sharpe, Beall, Fagan, Minnich & McKee

[57] ABSTRACT

A liquid squirting toy includes a tubular member having a front end and a rear end and including an interior chamber for holding a liquid. A cap is selectively securable to the tubular member front end. A squeeze bulb has a first end, which is secured to the tubular member rear end, and a second end. A first intake valve is located at the squeeze bulb first end and a second intake valve is located at the squeeze bulb second end.

18 Claims, 2 Drawing Sheets

PRESSURIZABLE LIQUID SQUIRTING TOY

BACKGROUND OF THE INVENTION

The present invention relates to a water squirt toy. More specifically, this invention discloses the use of a squeeze bulb secured to one end of a tubular member.

While the invention is particularly applicable to a water squirt toy utilizing a squeeze bulb to pressurize water held in a tubular water-retaining chamber of the toy. However, it will be appreciated by those skilled in the art that the invention can readily be adapted for use in other toy environments.

Water pistols are well known in the toy art. Also known are various other types of water squirting toys which may operate on the syringe principle. Some of these toys utilize a plunger to both pull water into the toy and to push water back out of the toy. It is also known to utilize a squeeze bulb to both suck water into a toy and to push the water back out of the toy. However, none of these types of toys has been found to be particularly advantageous in terms of quickly allowing the intake of water or another liquid into a water retaining chamber of the toy. In other words, the filling of the toy with water takes quite some time due to the small opening through which the water needs to flow. In addition, the known toys do not allow one to pressurize a liquid held in the toy by way of pneumatic pressure before expelling the liquid from the toy. While it is known to mechanically pressurize a liquid, such as by a plunger, the use of pneumatic pressure for this purpose is not known.

The present invention contemplates a new and improved liquid squirting toy which overcomes the above-referenced problems and others and provides a liquid squirting toy which is simple in design, economical to manufacture and simple to use.

BRIEF SUMMARY OF THE INVENTION

In accordance with the present invention, a new and improved liquid squirting toy is provided.

More particularly in accordance with this aspect of the invention, the liquid squirting toy comprises a tubular member having a front end and a rear end and including an interior chamber for holding a liquid. A cap is selectively securable to the tubular member front end. A squeeze bulb is secured, at a first end, to a rear end of the tubular member. The squeeze bulb also has a second end. A first intake valve is located at the squeeze bulb first end and a second intake valve is located at the squeeze bulb second end.

According to another aspect of the present invention, a toy is provided.

According to this aspect of the invention, the toy comprises a tubular member having a front end, a rear end and a hollow interior. An intake and exhaust means is located at the tubular member front end for admitting and exhausting a fluid from the hollow interior. A pressurizing means is secured to the tubular member rear end for pressurizing the fluid held in the tubular member hollow interior. A first check valve is interposed between the pressurizing means and the tubular member rear end.

According to still another aspect of the invention, a liquid squirting toy is provided.

According to this aspect of the invention, a liquid squirting toy comprises a tubular member having a front end and a rear end and an interior chamber. An intake and exhaust means is located at the tubular member front end for admitting and exhausting a liquid from the hollow interior. A squeeze bulb having a first end, a hollow interior and a second end is secured to the tubular member rear end. An intake means is secured to the squeeze bulb for selectively admitting a gas into the squeeze bulb hollow interior. The squeeze bulb is used for pressurizing the liquid held in the tubular member interior chamber.

One advantage of the present invention is the provision of a new and improved liquid squirting toy.

Another advantage of the present invention is the provision of a liquid squirting toy which employs a tubular member having a cap selectively securable thereon. When the cap is detached from the tubular member, the tubular member can be readily filled with a liquid through the large filling opening which is provided.

Still another advantage of the present invention is the provision of a liquid squirting toy which employs a means for pressurizing, secured to one end of the toy, to pressurize the liquid contents held in the toy.

Yet another advantage of the present invention is the provision of a liquid squirting toy which uses a squeeze bulb to selectively admit air into the toy to pneumatically pressurize the liquid contents held in the toy.

A further advantage of the present invention is the provision of a liquid squirting toy which employs a pair of intake valves, together with a squeeze bulb, to selectively admit air into the toy and to prevent the backflow of both air and a liquid held in the toy from out of the toy through the squeeze bulb.

A still further advantage of the present invention is the provision of a liquid squirting toy with a means for selectively blocking a port or nozzle opening of the toy. The means can be a slidable gate, a stopper or even a finger of the child using the toy.

A yet further advantage of the present invention is the provision of a liquid squirting toy having a relatively large inlet aperture for admitting a liquid into the toy and a relatively small outlet port for exhausting liquid from the toy.

Still other benefits and advantages of the subject new liquid squirting toy will become apparent to those skilled in the art upon a reading and understanding of this specification.

BRIEF DESCRIPTION OF THE DRAWINGS

The invention may take physical form in certain parts and arrangements of parts the preferred and alternate embodiments of which will be described in the specification and illustrated in the accompanying drawings which form a part hereof and wherein.

DETAILED DESCRIPTION OF THE PREFERRED AND ALTERNATE EMBODIMENTS

Figure 1:
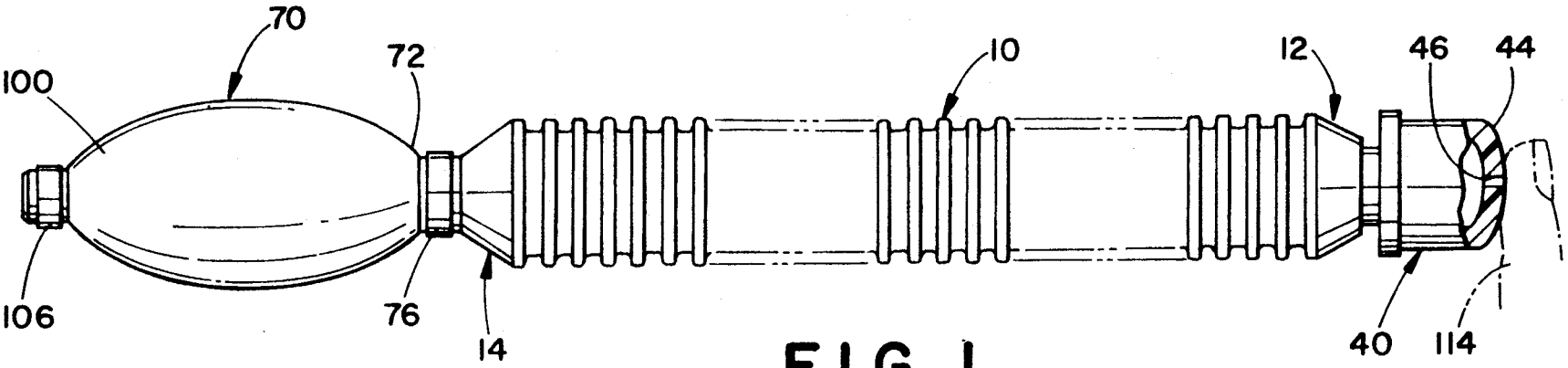
FIG. 1 is a side elevational view, in partial cross section, of a liquid squirting toy in accordance with a preferred embodiment of the present invention.
Figure 3:
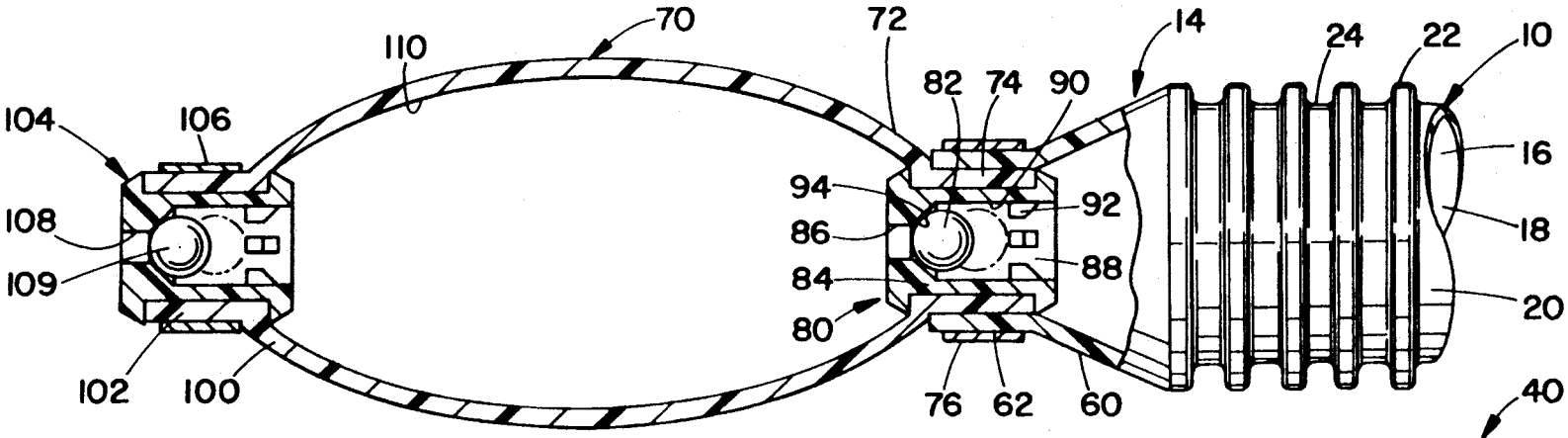
FIG. 3 is an enlarged side elevational view partially in cross section of a rear end of the toy of FIG. 1.

Referring now to the drawings wherein the showings are for purposes of illustrating the preferred and alternate embodiments of the invention only and not for purposes of limiting same, FIG. 1 shows a liquid squirting toy employing a tube 10 having a front end 12 and a rear end 14. As shown in FIG. 3, the tube defines an interior cavity 16 surrounded by an inner wall 18. Preferably, the tube is made from a conventional flexible material such as a suitable thermoplastic or any other type of suitable resilient material. An outer wall 20 of the tube 10 is defined by ribs 22 which are separated by grooves 24.

Figure 2:
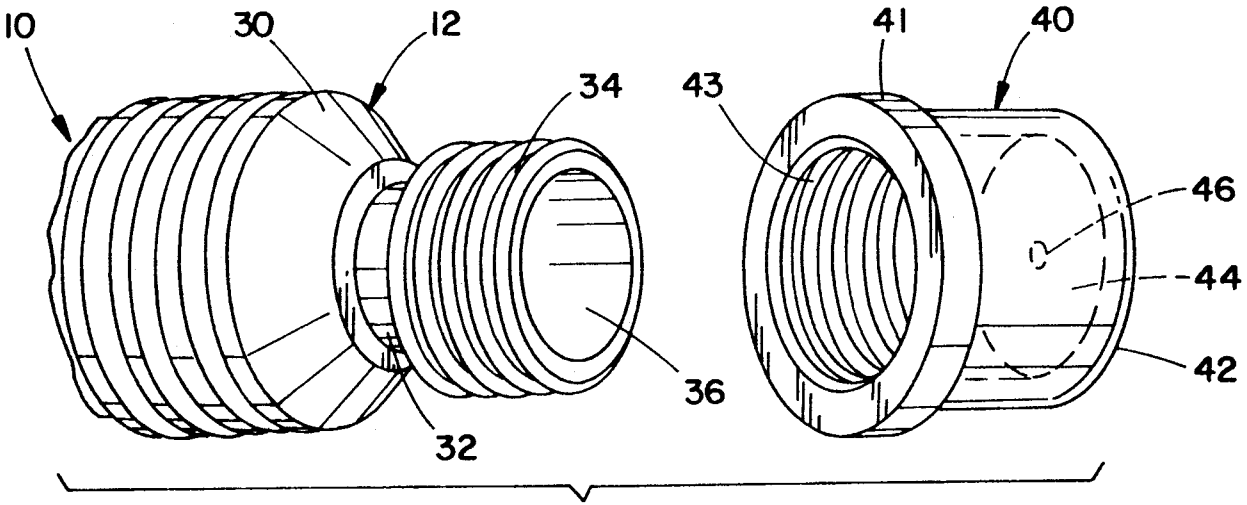
FIG. 2 is an enlarged exploded perspective view of a front portion of the toy of FIG. 1.

With reference now also to FIG. 2, the front end 12 of the tube includes a tapered wall 30 and extending therefrom a reduced diameter section 32. Defined on the reduced diameter section 32 is a threaded outer periphery 34. An intake means comprising a sizeable aperture or filling opening 36 at the front end of the reduced diameter section 32 allows water or a similar liquid to flow in and out of the tube cavity 16.

An exhaust means preferably in the form of a cap 40 selectively closes the tube front end 12. The cap includes a tubular body having an outwardly flared first end 41 and a closed second end 42. A threaded inner periphery 43 of the tubular body is adapted to cooperate with the outer periphery 34 of the tube 10 so that the cap can be selectively secured in place on the tube. Of course it should be appreciated that other ways of securing the cap 40 to the tube 10 could also be employed. Forming the closed second end 42 of the tubular body is an end wall 44. Extending through the end wall 44 is a substantially centrally located port or nozzle opening or bore 46.

With reference now again to FIG. 3, the rear end 14 of the tube includes a tapered wall 60 which leads to a reduced diameter section 62. A pressurizing means preferably in the form of a squeeze bulb 70 is secured to the rear end 14 of the tube 10. For this purpose, the squeeze bulb has a first end 72 including a reduced diameter section 74 which is so sized as to fit within the reduced diameter section 62 of the tube 10. A band 76 encircles the tube rear end reduced diameter section 62 to hold the tube and squeeze bulb together.

Provided within the squeeze bulb reduced diameter section 74 is a first check valve or intake valve 80. The check valve 80 is of a conventional design and includes e.g. a ball 82 which is confined in a housing 84. Provided on one end of the housing 84 is an aperture 86. Provided on the other end of the housing is a cage 88 defined by a bore 90 and a plurality of ribs 92 located adjacent one end of the bore and extending inwardly from the interior periphery of the bore toward the center thereof. The ribs 92 prevent the ball from being pushed out of the cage 88 when the ball is no longer seated on its seat 94 adjacent the aperture 86.

The squeeze bulb 70 also has a second end 100 which includes a reduced diameter section 102. Held within the reduced diameter section is a second check valve or intake valve 104 which may be identical to the first check valve 80. A band 106 encircles the reduced diameter section 102 and holds the check valve 104 in place. As with the first check valve 80, the second check valve includes an inlet aperture 108 and a ball 109. Located within the squeeze bulb 70 is a storage chamber 110. When manual pressure is exerted on the squeeze bulb 70, the air held within the squeeze bulb is pushed out through its first end 72 through the aperture 86, of the first check valve 80, around the ball 82 and into the cavity 16 of the tubular member 10.

Any reverse flow of air out of the squeeze bulb storage chamber 110 is prevented by the seating of the ball 109 of the second check valve 104. Similarly, any flow of liquid from the storage cavity 16 of the tube 10 into the squeeze bulb 70 is prevented by a seating of the ball 82 of the first check valve on its valve seat 94. When the squeeze bulb 70 is let go, the natural resilience of the material from which the squeeze bulb 70 is made (such material being a conventional resilient material such as rubber or the like) will expand the size of the storage chamber 110. This creates a drop in pressure in the chamber 110 in relation to the atmosphere thereby unseating the ball 109 of the second check valve 104 and allowing the entrance of air through the inlet aperture 108 into the storage chamber 110. Thereafter, when manual pressure is again reapplied to the squeeze bulb 70, an above atmospheric pressure is created in chamber 110. When this occurs the second check valve ball 109 seats and the first check valve ball 82 unseats to allow the outflow of such pressurized air into the cavity 16 of the tube 10 thereby pressurizing the liquid contents held in the cavity 16.

In order to fill the tube 10, the cap 40 is detached therefrom as shown in FIG. 2. This allows a free flow of liquid through the fairly sizeable aperture or filling opening 36 to quickly fill up the cavity 16 of the tube 10. After the cavity 16 is filled, the cap 40 can be threaded onto the tube 10 and the pneumatic pressurization of the liquid contents of the tube 10 can take place by use of the squeeze bulb 70. In order to prevent any outflow of liquid at this point, a means 114 for blocking the port or bore 46 of the cap 40 can be provided. As shown in FIG. 1, the means for blocking 114 can be a finger of the child using the toy.

Figure 4:
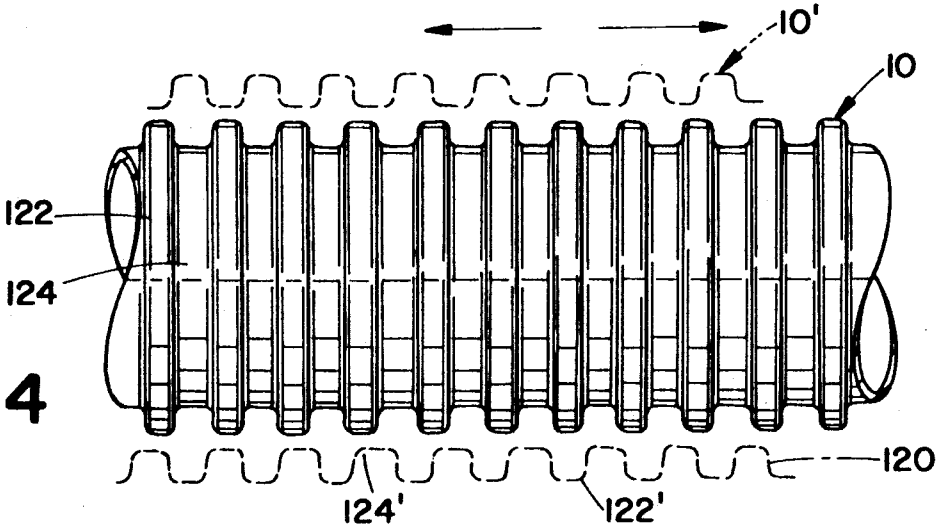
FIG. 4 is an enlarged side elevational view of a central tube portion of the toy of FIG. 1 illustrating in dotted lines the tube of the toy in a pressurized condition.

In this way, any liquid which may be held in the cavity 16 is pressurized pneumatically. This can perhaps best be seen in FIG. 4. This Figure illustrates that in an unpressurized condition, the tube 10 includes a plurality of spaced ribs 122 and 124. When the tube 10 is pressurized, as illustrated at 10', the ribs 122' and 124' are located further apart than were the ribs 122 and 124 in the unpressurized condition of the tube. When the means for blocking 114 is removed then the now pressurized liquid is squirted out of the tube 10 through the aperture 46 by the pneumatic pressure on the water and by natural resilience of the material from which the tube 10 is made.

Figure 5:
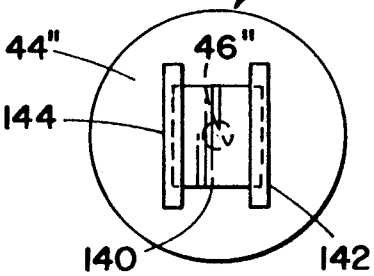
FIG. 5 is a front elevational view of a cap of a liquid squirting toy according to an alternate embodiment of the present invention; and, FIG. 6 is a side elevational view of a stopper and its tether of a liquid squirting toy according to another alternate embodiment of the present invention.

It should also be appreciated, however, that other means for blocking the port 46 can also be employed. With reference now to FIG. 5, an alternative means of blocking the port is there illustrated. For ease of comprehension of this alternative, like components are identified by like numerals with a double primed suffix (") and new components are identified by new numerals.

In this embodiment, a cap 40" is provided with an end face 44" on which is located a port 46". Selectively sealing the port is a gate 140 which is slidably mounted in a pair of suitably configured rails 142 and 144 secured on the cap 40". The gate 140 can be easily manuevered manually by the fingers of one hand to selectively block the port.

Figure 6:
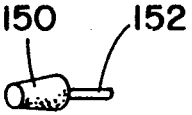

Alternatively, as is illustrated in FIG. 6, a stopper 150 can be provided to selectively seal the port. If desired, the stopper can be secured to the cap by a tether 152.

It is evident that by pneumatically pressurizing the liquid contents held in the tube 10, when the port 46 is blocked, the contents will be under some force. When the port is unblocked, the liquid contents will spray out with a relatively great force until pressures are equalized. Thereafter, the squeeze bulb 70 can again be employed to pressurize the remaining contents of the cavity 16 before such contents are ejected through the port 46. In this way, all of the contents of the cavity can be forcibly ejected. Once that is done, the tube 10 can again be quickly filled with liquid contents by simply removing the cap 40.

It should be appreciated that there is a considerable difference in size between the aperture 36 and the port 46. Thus, water will quickly fill the toy but the spray of water out of the toy will take some time, thus adding to the enjoyment of the toy.

The invention has now been described with reference to the preferred and alternate embodiments. Obviously, alterations and modifications will occur to others upon a reading and understanding of this specification. It is intended to include all such modifications and alterations insofar as they come within the scope of the appended claims or the equivalents thereof.

What is claimed is:

1. A liquid-squirting toy comprising:

a tubular member having a front end and a rear end and including an interior chamber for holding a liquid, said tubular member comprising a resilient expandable material which can expand when liquid contents held in said interior chamber are pressurized by a gas;

a cap selectively securable to said tubular member front end;

a squeeze bulb having a first end, secured to said tubular member rear end, and a second end;

a first intake valve located at said squeeze bulb first end; and, a second intake valve located at said squeeze bulb second end, said squeeze bulb and first and second valves cooperating to pressurize a gas and direct it into said tubular member interior chamber.

2. The toy of claim 1 wherein said cap includes a port which allows an outflow of liquid therethrough from said tubular member interior chamber.

3. The toy of claim 2 further comprising a means for selectively blocking said port.

4. The toy of claim 1 wherein said tubular member comprises a flexible hose.

5. The toy of claim 4 wherein said hose includes ribs extending circumferentially around its exterior periphery.

6. The toy of claim 1 wherein said squeeze bulb comprises a manually compressible resilient pneumatic bulb in air flow communication with said tubular member rear end through said first valve.

7. The toy of claim 6 wherein operation of said squeeze bulb pneumatically pressurizes the liquid held in said tubular member.

8. A toy comprising:

a tubular member having a front end and a rear end and a hollow interior;

an intake means located at said tubular member front end, wherein said intake means comprises an aperture for allowing an inflow of fluid;

an exhaust means attached to said tubular member front end and secured over said intake means for exhausting a fluid from said hollow interior wherein said exhaust means comprises a cap selectively securable to said tubular member front end wherein said cap includes a port to allow an outflow of fluid therethrough and a means for selectively blocking said port;

a pressurizing means secured to said tubular member rear end for pressurizing a fluid held in said tubular member hollow interior; and, a first check valve interposed between said pressurizing means and said tubular member rear end.

9. The toy of claim 8 further comprising a pressurizable fluid intake means, cooperating with said pressurizing means, for allowing an inflow of a pressurizable fluid into said pressurizing means.

10. The toy of claim 8 wherein said tubular member comprises a resilient expandable material which can expand when contents held in said tubular member are pressurized.

11. The toy of claim 8 wherein said pressurizing means comprises a manually compressible resilient pneumatic bulb having a first end in air flow communication with said tubular member rear end through said first check valve.

12. The toy of claim 11 further comprising a second check valve located on a second end of said resilient pnuematic bulb.

13. A liquid-squirting toy comprising:

a tubular member having a front end and a rear end and an interior chamber;

an intake means located at said tubular member front end for admitting a liquid to said interior chamber;

an exhaust means attached to said tubular member front end and secured over said intake means for exhausting the liquid from said interior chamber, wherein said exhaust means comprises a port and a means for selectively preventing an outflow of the liquid through said port;

a squeeze bulb having a first end, secured to said tubular member rear end, a hollow interior and a second end; and, a gas intake means secured to said squeeze bulb for selectively admitting a gas into said squeeze bulb hollow interior, said squeeze bulb being used for pressurizing the gas and hence the liquid held in said tubular member interior chamber.

14. The toy of claim 13 wherein said exhaust means comprises a cap and said cap includes said port.

15. The toy of claim 13 wherein said intake means comprises a relatively large first aperture for allowing an airflow of the liquid when said exhaust means is not attached to the tubular member front end and wherein said port comprises a relatively small second aperture for allowing an outflow of the liquid.

16. The toy of claim 13 wherein said gas intake means comprises a one way valve.

17. The toy of claim 13 wherein said tubular member comprises a flexible hose having a ribbed outer periphery.

18. The toy of claim 17 wherein said flexible hose comprises a resilient expandable material which can expand when contents held in said flexible hose are pressurized.

* * * * *